US011945619B2

(12) United States Patent
Jung et al.

(10) Patent No.: US 11,945,619 B2
(45) Date of Patent: Apr. 2, 2024

(54) PACKAGING MACHINE WITH FOIL TRANSPORT DEVICE AND METHOD

(71) Applicant: MULTIVAC SEPP HAGGENMUELLER SE & CO. KG, Wolfertschwenden (DE)

(72) Inventors: Patrick Jung, Kempten (DE); Albert Gabler, Lachen-Albishofen (DE)

(73) Assignee: Multivac Sepp Haggenmueller SE & Co. KG, Wolfertschwenden (DE)

( * ) Notice: Subject to any disclaimer, the term of this patent is extended or adjusted under 35 U.S.C. 154(b) by 0 days.

(21) Appl. No.: 17/881,376

(22) Filed: Aug. 4, 2022

(65) Prior Publication Data

US 2023/0038155 A1 Feb. 9, 2023

(30) Foreign Application Priority Data

Aug. 5, 2021 (DE) ..... 102021120371.6

(51) Int. Cl.
*B65B 57/08* (2006.01)
*B65B 41/12* (2006.01)
(Continued)

(52) U.S. Cl.
CPC ..... *B65B 57/08* (2013.01); *B65B 41/12* (2013.01); *B65H 23/1888* (2013.01);
(Continued)

(58) Field of Classification Search
CPC ..... B65B 57/08; B65B 41/12; B65H 23/1888; B65H 23/192; B65H 2513/10;
(Continued)

(56) References Cited

U.S. PATENT DOCUMENTS 3,625,447 A * 12/1971 Hank ..... B65H 23/063 242/422.4
4,519,039 A * 5/1985 Surana ..... G05D 17/02 318/7
(Continued)

FOREIGN PATENT DOCUMENTS

DE 101 55 039 A1 11/2002
DE 10 2017 131 417 A1 7/2019
(Continued)

OTHER PUBLICATIONS

European Search Report (with English Machine Translation) dated Jan. 23, 2023, Application No. 22185621.4-1014, Applicant MULTIVAC Sepp Haggenmueller SE & Co. KG, 12 Pages.
(Continued)

*Primary Examiner* — Dariush Seif
(74) *Attorney, Agent, or Firm* — Brooks Kushman P.C.

(57) ABSTRACT

A packaging machine may include a foil transport device and a controlling system for controlling an operation of at least one drive unit of the foil transport device. The controlling system is designed to activate the drive unit during a production run of the packaging machine on the basis of a speed- and/or temperature-dependent friction moment characteristic curve detected by means of a rotationally driven measurement run carried out by the drive unit. The disclosure furthermore relates to a method for controlling a drive unit of a foil transport device.

13 Claims, 4 Drawing Sheets

(51) Int. Cl.
*B65H 23/188* (2006.01)
*B65H 23/192* (2006.01)

(52) U.S. Cl.
CPC ..... *B65H 23/192* (2013.01); *B65H 2513/10* (2013.01); *B65H 2515/32* (2013.01); *B65H 2515/40* (2013.01); *B65H 2557/242* (2013.01); *B65H 2557/63* (2013.01)

(58) Field of Classification Search
CPC ..... B65H 2515/32; B65H 2515/40; B65H 2557/242; B65H 2557/63
USPC ..... 53/64
See application file for complete search history.

(56) References Cited

U.S. PATENT DOCUMENTS 4,920,621 A * 5/1990 Metzen ..... D06C 21/00 26/18.5
5,199,623 A * 4/1993 Rajala ..... F26B 13/104 34/641
5,640,835 A * 6/1997 Muscoplat ..... B43M 5/04 53/284.3
6,039,282 A * 3/2000 Hermanns ..... B65H 63/00 242/477.8
6,433,499 B1 * 8/2002 Cote ..... G01L 5/0085 318/434
7,798,382 B2 * 9/2010 Zentgraf ..... B65H 23/1888 226/42
2001/0027731 A1 * 10/2001 Schramm ..... B65H 23/192 101/216
2004/0146602 A1 * 7/2004 Garwood ..... B65D 81/2076 426/35
2005/0178095 A1 * 8/2005 Rimondi ..... B29C 66/81265 53/550
2008/0047115 A1 * 2/2008 Knabel ..... B65H 23/025 26/99
2009/0020641 A1 * 1/2009 Loddenkoetter ..... B41F 13/02 226/25
2009/0039130 A1 * 2/2009 Schultze ..... B41F 13/02 226/1
2009/0101747 A1 * 4/2009 Doeres ..... B65H 19/10 242/534.2
2009/0145943 A1 * 6/2009 Schnabel ..... B65H 23/188 226/42
2009/0162126 A1 * 6/2009 Schultze ..... B41F 23/04 400/618
2011/0062205 A1 * 3/2011 Schnabel ..... B65H 23/1888 226/10
2011/0064500 A1 * 3/2011 Takahashi ..... B65H 5/34 271/265.01
2011/0169217 A1 * 7/2011 Ziegler ..... B65H 43/00 83/13
2011/0226885 A1 * 9/2011 Fries ..... B65H 59/387 242/420
2011/0246127 A1 * 10/2011 Schnabel ..... B65H 23/192 702/145
2011/0307082 A1 * 12/2011 Schultze ..... B41F 13/14 700/44
2011/0315036 A1 * 12/2011 Bouma ..... B41J 15/04 226/42
2013/0016168 A1 * 1/2013 Noguchi ..... B65H 20/38 347/110
2014/0217118 A1 * 8/2014 Kuismanen ..... B67D 7/0216 222/102
2014/0249007 A1 * 9/2014 Ehrmann ..... B65B 41/14 493/102
2015/0241875 A1 * 8/2015 Ehrbar ..... G05B 19/41865 700/122
2016/0279981 A1 * 9/2016 Ruiz Floriach ..... B41F 33/06
2016/0280405 A1 * 9/2016 Thieme ..... B65B 13/027
2019/0104228 A1 * 4/2019 Arimori ..... B65H 7/06
2019/0308760 A1 * 10/2019 Mayer ..... B65H 23/185
2020/0039673 A1 * 2/2020 Mitchell ..... B65B 41/16
2021/0155436 A1 * 5/2021 Haapanen ..... D21F 9/00
2021/0214110 A1 7/2021 Rehn et al.
2023/0038155 A1 * 2/2023 Jung ..... B65B 41/12

FOREIGN PATENT DOCUMENTS

EP 1 947 437 A1 7/2008
WO WO-2019219966 A1 * 11/2019 ..... B65B 41/16
WO 2020/229355 A1 11/2020

OTHER PUBLICATIONS

German Search Report dated Mar. 14, 2022, Application No. 10 2021 120 371.6, Applicant MULTIVAC Sepp Haggenmueller SE & Co. KG, 6 Pages.

* cited by examiner

PACKAGING MACHINE WITH FOIL TRANSPORT DEVICE AND METHOD

CROSS-REFERENCE TO RELATED APPLICATIONS

This application claims foreign priority benefits under 35 U.S.C. § 119(a)-(d) to German patent application number DE 10 2021 120 371.6, filed Aug. 5, 2021, which is incorporated by reference in its entirety.

TECHNICAL FIELD

The present disclosure relates to a packaging machine. The disclosure furthermore relates to a method for controlling a drive unit of a foil transport device.

BACKGROUND

Besides a high process reliability and performance of a packaging machine, the reduction of packaging material is a substantial demand by the customer which packaging machine manufacturers are increasingly confronted with. This means that increasingly thinner foils are to be employed and the foil waste in the packaging process, in particular a strip of foil edges which cannot be processed into packages, must be minimized.

In practice, servo drives for activating foil take-ups and foil remainder winders are already employed in packaging machines, for example, in intermittently operating deep-drawing packaging machines or tray sealers. By means of such servo drives, it is possible to control the foil tension via a torque default. The customer thereby gets the option of individually adjusting the foil tension whereby thin foils can be better transported and only very narrow strips of foil edges remain in the manufacture of packages.

It showed, however, that the conventional torque default control can be influenced by disturbance variables occurring during a packaging process, for example, due to a changing operating temperature and/or due to varying servomotor speeds, such that no constant and reproducible foil tension is achieved during the packaging process.

Above all, operation-related own dynamics of each drive employed for the foil transport device can be problematic since it can provoke a foil tension that varies during the production run or packaging process of the packaging machine. A foil tension changing during the production run, however, leads to fatigue phenomena just in thin foils and can furthermore result in a visible damage of the foil material during the production run, for example in fissures at fatigue points. The involved interruption of the production run, optionally to clamp the foil material again, reduces the productivity of the packaging machine.

SUMMARY

It is an object of the disclosure to provide a packaging machine and a method by which the processing of thin foil material is better possible.

The disclosure relates to a packaging machine having a foil transport device and a controlling system for controlling an operation of at least one drive unit of the foil transport device. The packaging machine according to the disclosure is in particular present in the form of a deep-drawing packaging machine or in the form of a tray closing machine, also referred to as tray sealer by experts.

According to the disclosure, the controlling system is designed to activate the drive unit during a production run of the packaging machine on the basis of a speed- and/or temperature-dependent friction moment characteristic curve detected by means of a rotationally driven measurement run carried out by the drive unit.

The measurement run carried out by means of the drive unit takes place separately from the production run, i.e., separately from the packaging process of the packaging machine. In the disclosure, the measurement run serves to determine an own friction that can be measured at the drive unit and varies due to the operation. Thus, the measurement run takes place as a friction detection run as a basis for the actual production run to be carried out by means of the packaging machine.

The characteristic progression of the own friction measurable at the drive unit can be derived, for example, proportionally from a power supply required for the measurement run and detected at the drive unit. The friction moment characteristic curve obtained thereby is then considered in the actual production run for the activation of the drive unit to maintain a desired foil tension despite the varying own friction moment of the drive unit constantly, i.e., without any variations of the tension. In other words, by the disclosure, the own friction of the drive unit during the production run detected by the measurement run can be compensated such that a constant foil tension occurs during the production run thereby.

By means of the characteristic friction moment characteristic curve detected for the drive unit by means of the measurement run performed thereat, which can be determined, for example, directly proportionally to a speed-dependent current feed of the drive unit detected during the measurement run, it is possible to detect the own friction of the drive unit and to consider it as a basis in the activation of the drive unit during the production run executed separately, in particular directly subsequently or only later, to achieve a constant foil tension. The measurement run performed for the production run thus serves to detect the friction dynamics of the drive unit which is considered in the activation in the production run to prevent the foil material from being subjected to varying stresses. Thereby, very thin foils can be reliably processed into perfect packages.

By means of the friction moment characteristic curve determined by means of the measurement run, at least the mechanical influence of the own friction of the drive unit can be detected at various speeds employable for the production run and be compensated in a corresponding activation of the drive unit. It is therefore possible to perform a current supply at the drive unit such that a current supply assumed for achieving a desired foil tension is corrected with respect to the own friction moment of the drive unit detected by means of the measurement run at a speed assumed for it.

In particular, the measurement run can be performed as a velocity-dependent, that means speed-dependent, friction detection run to determine the own friction of the drive unit. It is practical for the measurement run to be performed without any foil material. According to a variant, the measurement run can be performed depending on the operating hours, for example at certain intervals, to consider a current own friction of the drive unit. It is conceivable that a measurement run function can be invoked by an operator at the packaging machine for performing the measurement run, for example, at an operator terminal provided thereat.

The foil transport device can be an upper foil transport device for transporting an upper foil and/or a lower foil transport device for transporting a lower foil by means of which the upper foil and/or lower foil can be supplied, during the production run of the packaging machine, to a working process performed thereat with a desired foil tension. In particular, the upper foil transport device is designed to supply the upper foil to a sealing station of a deep-drawing packaging machine or a tray sealer. The lower foil transport device can be employed at a deep-drawing packaging machine to supply the lower foil to a shaping station of the deep-drawing packaging machine.

Preferably, the drive unit (e.g., any drive unit mentioned herein) includes a servo drive. This can comprise a servo motor and a servo controller which dynamically controls the operation of the drive unit on the basis of the friction moment characteristic curve to achieve a constant foil tension during the production run. The friction moment characteristic curve, in particular the power supply of the drive unit on which the friction moment characteristic curve is based, can be switched on for compensating the own friction of the drive unit as a characteristic curve pre-control depending on the disturbance variable and/or as a disturbance variable feedforwarding to the servo drive, in particular for the servo controller.

In particular, the drive unit (e.g., any drive unit mentioned herein) may include a transmission, in particular a transmission with a plurality of transmission ranges. The transmission and the servomotor include an individual own friction that can influence the foil tension. The respective friction moments, however, can be determined cumulatively for the drive unit by means of the measurement run and thus be considered systematically in the activation of the drive unit by means of the resulting friction moment characteristic curve.

It is conceivable for the drive unit to be activated for detecting the friction moment characteristic curve over a total speed range of the drive unit. For this, the drive unit could be successively accelerated, during the measurement run, from its standstill until the maximum speed is reached. By this, the own friction of the drive unit can be detected, for example at different speed stages, over the total speed range and be employed as a basis for activating the drive unit during the production run. The result of the friction detection run could be stored by means of an electronic storage unit of the controlling system to be employed in future for packaging processes of the packaging machine.

Preferably, the drive unit can be accelerated during the measurement run for detecting the friction moment characteristic curve by means of stepwise, continuously increasing speed levels, i.e., by means of velocity steps that are getting increasingly faster. The friction moment can be reliably detected by means of the increasing velocity steps, in particular if a substantially constant current feed can be measured for the respective velocity steps. This is pictured by a plateau in the power curve.

It would be conceivable for the controlling system to include a filter function to temporarily filter out power peaks occurring due to the speed increase, each at the beginning of a velocity step adjusted during the measurement run. From the power supply of the drive unit detected during the measurement run, the characteristic friction moment characteristic curve of the drive unit results in particular in a directly proportional context. It is conceivable for the controlling system to be configured to generate, from a plurality of friction moments detected during the measurement run, an interpolated friction moment characteristic curve.

According to one variant, the controlling system is designed to determine a measurement run temperature of the drive unit rotationally driven during the measurement run. To this end, the drive unit, in particular a servomotor formed thereat, can include at least one temperature sensor by means of which the measurement run temperature can be detected during the friction detection run. Preferably, the temperature sensor can moreover be employed for measuring a current operating temperature of the drive unit during the production run.

In one practical variant, the measurement run is performed such that the recording of the friction moment characteristic curve takes place during a constant measurement run temperature. For the accuracy of the activation of the drive unit during the production run, it showed that a measurement run temperature within a range of 3° C. to 8° C., in particular of 5° C. to 6° C., is suited for detecting the related friction moment characteristic curve. Above all, the controlling system can select a window of time of the measurement run such that the measurement run can be performed at a constant measurement run temperature. It proved to be practicable for the measurement run to be performed at a constant measurement run temperature of 5° C.

In a preferred variant, the controlling system is configured to determine, on the basis of at least one friction moment-temperature characteristic curve stored to the controlling system for the drive unit, a temperature compensation factor for the activation of the drive unit derived therefrom in view of a currently detected operating temperature of the drive unit and in view of the measurement run temperature detected during the measurement run.

In particular, the controlling system is designed to correct the speed-dependent friction moment characteristic curve detected by means of the measurement run, in particular a required power supply of the drive unit that can be derived therefrom for reaching a desired foil tension, determined using the operating temperature currently prevailing at the drive unit. By this, the own friction having a tendency to decrease during the production run as the operating temperature rises can be considered in the activation of the drive unit. With this temperature compensation, the desired foil tension can be even better maintained during the production run.

The friction moment temperature characteristic curve only has to be determined once for the drive unit, i.e., for its modular structure. It would be conceivable for the friction moment temperature characteristic curve to be determined in view of the respective function units of the drive unit. Tests showed that deviations of the friction moment temperature behavior are very low within a transmission series employed for the drive unit and can accordingly be neglected.

Above all, the temperature compensation factor can be derived, as a temperature-dependent quotient, from the friction moment temperature characteristic curve stored to the controlling system for the respective drive unit. In particular, the quotient is formed, in view of the friction moment temperature characteristic curve, from the friction moment indicated from it for the current operating temperature and the friction moment indicated from it in view of the measurement run temperature.

During the production run, a power supply actually required for the current operating temperature assumed on the basis of the friction moment characteristic curve can be preferably continuously derived by means of the temperature compensation factor determined for the current operating temperature and for the measurement run temperature of the drive unit, in order to achieve a constant foil tension during the production run despite a rising operating temperature of the drive unit. As the operating temperature rises, the power torque actually required for achieving the desired foil tension therefore proportionally decreases whereby temperature influences on the friction behavior of the drive unit can be compensated. By this, a constant and reproducible foil tension can be advantageously achieved during the production run even with varying operating temperatures of the drive unit, so that the use of very thin foils is permitted.

As already indicated above, the packaging machine can be embodied as a deep-drawing packaging machine or as a tray sealer. In the form of a deep-drawing packaging machine, the foil transport device could be present as an upper foil transport device to supply an upper foil to a sealing station of the deep-drawing packaging machine with a desired foil tension. Such an upper foil transport device can be comparably formed at the tray sealer.

Preferably, the foil transport device includes at least one further drive unit, the controlling system being designed to activate the further drive unit during a production run of the packaging machine on the basis of a speed- and/or temperature-dependent further friction moment characteristic curve detected by means of a rotationally driven measurement run carried out by the further drive unit. The two drive units can thus be operated on the basis of their own friction such that they together transport the foil clamped between them with a constant and reproducible foil tension during the production run.

It would be possible for a respective measurement run to take place for all drive units employed at the foil transport device for the foil transport, for example, simultaneously and/or during a commissioning of the packaging machine, to detect a separate friction moment characteristic curve for the respective drive unit and store it in the controlling system.

The foil transport device according to the disclosure could be a lower foil transport device at the deep-drawing packaging machine to supply a lower foil mounted at the entry of the deep-drawing packaging machine in the production direction to a shaping station positioned downstream for producing troughs by means of a desired foil tension. Here, the desired foil tension can be achieved in that a dynamic activation of the drive unit of a foil roller mounting mounted at the entry of the deep-drawing packaging machine carried out on the basis of the friction moment characteristic curve, and a dynamic activation of the further drive unit carried out on the basis of the further friction moment characteristic curve is accomplished, which moves a clamp chain for the lower foil in view of a cycle of the packaging machine in the production direction.

The activation of the measurement run of the further drive unit can be performed in a way similar to that already described above for the inventive drive unit. In particular, the inventive drive unit and the further drive unit can be activated in a coordinated manner such that they can compensate a temperature influence each present at them during the production run to achieve together a constant and reproducible foil tension.

It is conceivable that the drive unit rotates a foil take-up and the further drive unit rotates a foil remainder winder. It is in particular possible to individually adjust a desired foil tension for different foil types at the controlling system and to achieve a constant and reproducible foil tension despite temperature changes during the production run. Such an adjustment function could be also provided, as an alternative or supplement, directly at the foil take-up and/or at the foil remainder winder.

The disclosure furthermore relates to a method for controlling at least one drive unit of a foil transport device that supplies a foil with a predetermined foil tension at a packaging machine to a workstation of the packaging machine during a production run taking place thereat. In particular, the foil transport device is configured to supply an upper foil with a predetermined foil tension to a sealing station of the packaging machine during a production run taking place at the packaging machine. The foil transport device can alternatively be employed to supply a lower foil with a predetermined foil tension to a shaping station of the packaging machine.

According to the disclosure, the drive unit is controlled, during a production run of the packaging machine, on the basis of a speed- and/or temperature-dependent friction moment characteristic curve detected by means of a rotationally driven measurement run carried out by the drive unit. Independent of whether the foil transport device is employed for the transport of an upper foil or a lower foil, a constant and reproducible foil tension can be thereby better kept in the foil material during the production run. This is due to the fact that in the activation of the drive unit taking into consideration the friction moment characteristic curve detected by means of the measurement run, own dynamics of the drive unit can be largely compensated.

It makes sense for the drive unit to be rotated in both directions during a predetermined running-in interval before a start of the measurement run. By means of the running-in interval performed in such a way in opposite directions, adhesion effects can be removed at the drive unit whereby the measurement run can be subsequently performed more precisely to detect the own friction of the drive unit, preferably in steps over the total speed range.

It is convenient for the drive unit to be accelerated, during a measurement section of the measurement run performed after the running-in interval, in steps with a continuously increasing speed to determine the friction movement characteristic curve. This results in a stepwise increasing speed characteristic curve. Depending on this, the current feed of the drive unit, which is directly proportional to the power torque present thereat, can be measured.

In particular, the measurement run can be controlled such that the speed leaps become continuously larger. Thereby, the own friction of the drive unit can be altogether recorded more precisely. Above all, this can lead to a window of measurement time for the measurement run in which no temperature change of the drive unit occurs during the measurement run.

Preferably, the controlling system determines, on the basis of a friction moment-temperature characteristic curve stored to it for the drive unit, a temperature compensation factor in view of a currently detected operating temperature of the drive unit during the production run and in view of a measurement run temperature detected during the measurement run for the activation of the drive unit. By means of the temperature compensation factor, the controlling system can compensate the temperature-dependent own friction of the drive unit during the production run. In other words, the controlling system can thereby continuously determine a temperature compensation factor dynamically adapted to the current operating temperature of the drive unit during the production run and continuously employ it in the activation of the drive unit for the compensation of the temperature-dependent own friction. By means of this temperature compensation, a constant and reproducible foil tension can be achieved during the production run.

In an advantageous variant, the controlling system derives a power supply of the drive unit for achieving a desired foil tension from the detected friction moment characteristic curve during the production run and dynamically adapts this assumed power supply by means of the temperature compensation factor determined in view of the current operating temperature. The friction moment characteristic curve, which can be determined by means of the measurement run for the drive unit, thus supplies a characteristic curve characteristic of the own friction of the drive unit from which an actually required power supply for the drive unit dynamically adapted by means of the temperature compensation factor can be derived to supply the foil material to the packaging process with a desired constant and reproducible foil tension.

On the basis of the measurement run temperature measured during the friction detection run and in view of the current operating temperature of the drive unit, a quotient can be derived from the friction moment-temperature characteristic curve stored to the controlling system which indicates the temperature compensation factor for the current operating temperature. By this, the actually required power supply of the drive unit can be dynamically determined during the production run, in view of the own friction present at the drive unit and taking into consideration the operating temperature detected thereat, in order to transport the foil material with a constant foil tension.

By means of the present disclosure, it is possible to record the own friction characteristic of the drive unit, including a servomotor formed thereon, a transmission formed thereon, and/or bearings formed thereon, that means its general, speed- and/or temperature-related own dynamics, by means of the performance of the measurement run and the friction moment characteristic curve detected thereby. A friction moment derived therefrom for a desired foil tension or a power supply of the drive unit employed for it to achieve the desired foil tension can moreover be adapted by means of the temperature compensation factor in view of a special, i.e., currently measured, operating temperature of the drive unit to compensate the influence of a changing operating temperature during the production run on the friction behavior of the drive unit so that the foil tension is highly constant and reproducible during the production run.

BRIEF DESCRIPTION OF THE DRAWINGS

The disclosure will be described more in detail with reference to the following figures. In the drawing.

Figure 1:
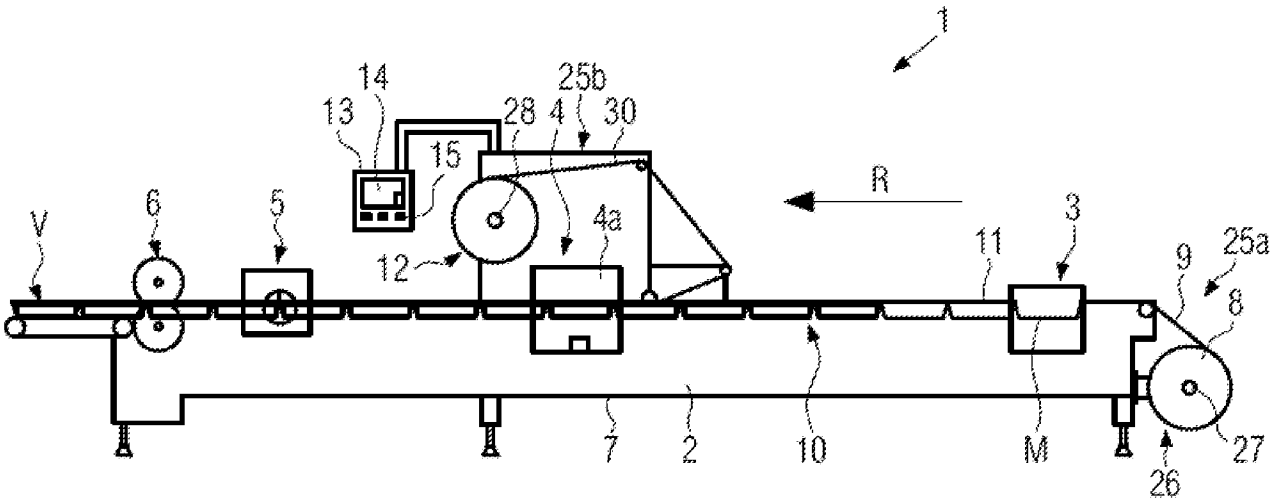
FIG. 1 shows a schematic side view of a packaging machine embodied as a deep-drawing packaging machine.

Equal components are always provided with equal reference numerals in the figures.

DETAILED DESCRIPTION

FIG. 1 shows, in a schematic side view, a packaging machine 1 embodied as an intermittently operating deep-drawing packaging machine 2. This deep-drawing packaging machine 2 includes a shaping station 3, a sealing station 4, a cross cutter 5, and a longitudinal cutter 6 which are arranged in this order at a machine frame 7 in a direction of transport R. At the entry side, a feed roller 8 is located at the machine frame 7, a lower foil 9 being reeled off from said roller. Furthermore, the deep-drawing packaging machine 2 includes a transport chain 11, in particular transport chains or clamp chains 11, respectively, arranged at both sides, which grips the lower foil 9 and transports it further in the direction of transport R per main cycle.

In the represented embodiment, the shaping station 3 is embodied as a deep-drawing station in which troughs M are formed into the lower foil 9 by deep-drawing, for example by means of compressed air and/or a vacuum. The shaping station 3 can be designed such that several troughs M are formed next to each other in the direction perpendicular to the direction of transport R. In the direction of transport R downstream of the shaping station 3, a filling section 10 is provided in which the troughs M formed in the lower foil 9 are filled with products.

The sealing station 4 has a hermetically closable chamber 4*a* in which the atmosphere in the troughs M is e.g., evacuated and/or can be replaced by a replacement gas or a gas mixture by gas flushing before they are sealed with the upper foil 30 discharged by an upper foil transport device 12.

The transverse cutter 5 can be embodied as a stamping machine which cuts through the lower foil 9 and the upper foil 30 in a direction transverse to the direction of transport R between adjacent troughs M. In the process, the transverse cutter 5 operates such that the lower foil 9 is not cut through across its total width, but is not cut through at least in an edge region. This permits a controlled further transport through the transport chain 11.

The longitudinal cutter 6 can be embodied as a knife arrangement by which the lower foil 9 and the upper foil 30 are cut through between adjacent troughs M and at the lateral edge of the lower foil 9 in the direction of transport R so that singled packages V are provided downstream of the longitudinal cutter 6.

The deep-drawing packaging machine 2 furthermore includes a controlling system 13. The latter has the task of controlling and monitoring the processes running in the deep-drawing packaging machine 2. A display device 14 with operational controls 15 serves to visualize or influence the process operations in the deep-drawing packaging machine 2 for or by an operator.

Figure 2:
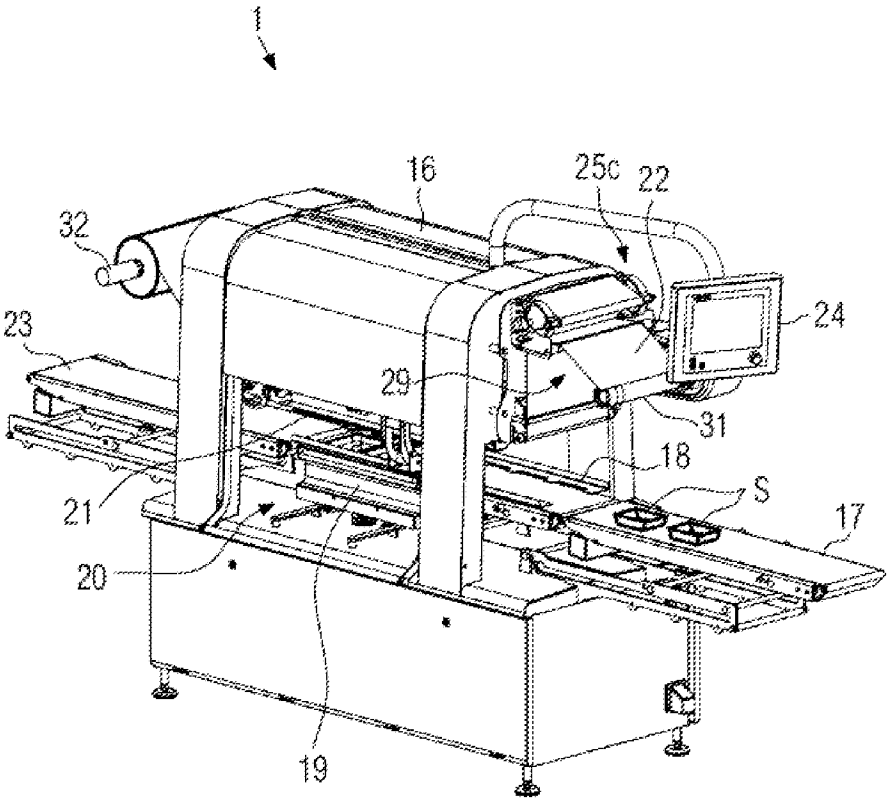
FIG. 2 shows a perspective representation of a packaging machine present as a tray sealer.

FIG. 2 shows a tray sealing machine 16. This is also referred to as a tray sealer by experts. Package bowls S are provided at the tray sealer 16 on a feed belt 17. The tray sealer 16 has a gripper device 18 by means of which the package bowls S provided on the feed belt 17 are picked up and transferred to a lower sealing tool part 19 of the sealing station 20 for a tray sealing operation. During the tray sealing operation, the lower sealing tool part 19 is lifted against an upper sealing tool part 21 positioned above it to seal the package bowls S with an upper foil 22 guided through the sealing station 20. Via the upper sealing tool part 21 and/or the lower sealing tool part 19, a gas treatment process can be performed before the tray sealing operation to produce a desired atmosphere within the package bowls S positioned in the sealing station 20. After the tray sealing operation, the sealing station 20 is opened by lowering the lower sealing tool part 19. Now, the packages sealed with a desired atmosphere can be picked up by means of the gripper device 18 and transferred to a discharge belt 23.

The tray sealer 16 of FIG. 2 has a controlling system 24. The latter has the task of controlling and monitoring the processes running in the deep-drawing packaging machine 16.

At the packaging machines shown in FIG. 1 and in FIG. 2, that means at the deep-drawing packaging machine 2 and at the tray sealer 16, it is advantageous to supply the respective foils to the respective workstations with a certain constant foil tension reproducible per machine cycle.

In the deep-drawing packaging machine 1, a lower foil transport device 26 is employed for this as a foil transport device 25*a* in the entry of the deep-drawing packaging machine 1. The lower foil transport device 26 comprises a drive unit 27. The controlling system 13 is configured to control an operation of the drive unit 27. By means of the drive unit 27 and by means of an activation of a further, non-depicted drive unit of the transport chains 11, the lower foil 9 can be supplied to the shaping station 3 with a desired foil tension for the shaping process taking place therein.

Furthermore, FIG. 1 shows, as the foil transport device 25*b*, the upper foil transport device 12 which includes a drive unit 28 to supply the upper foil 30 to the sealing station 4 with a desired foil tension. The upper foil transport device 12 can be activated by means of the controlling system 13 such that the upper foil 30 is supplied to the sealing station 4 with the desired foil tension. The drive unit 28 of the upper foil transport device 12 can here be activated in a manner coordinated with the transport chains 11 to achieve the desired foil tension in the upper foil 30.

In FIG. 2, as the foil transport device 25*c*, a further upper foil transport device 29 is provided which is configured to supply the upper foil 22 to the sealing station 20 with a desired foil tension. The upper foil transport device 29 shown in FIG. 2 has a drive unit 31 which can be activated by means of the controlling system 24. The tray sealer 16 furthermore has a remainder foil winder 42 which winds up the upper foil 22 remaining after the sealing process. The drive unit 31 and a drive unit 32 of the remainder foil winder 42 can be activated by means of the controlling system 24 for a controlled foil transport with a desired foil tension.

Figure 3:
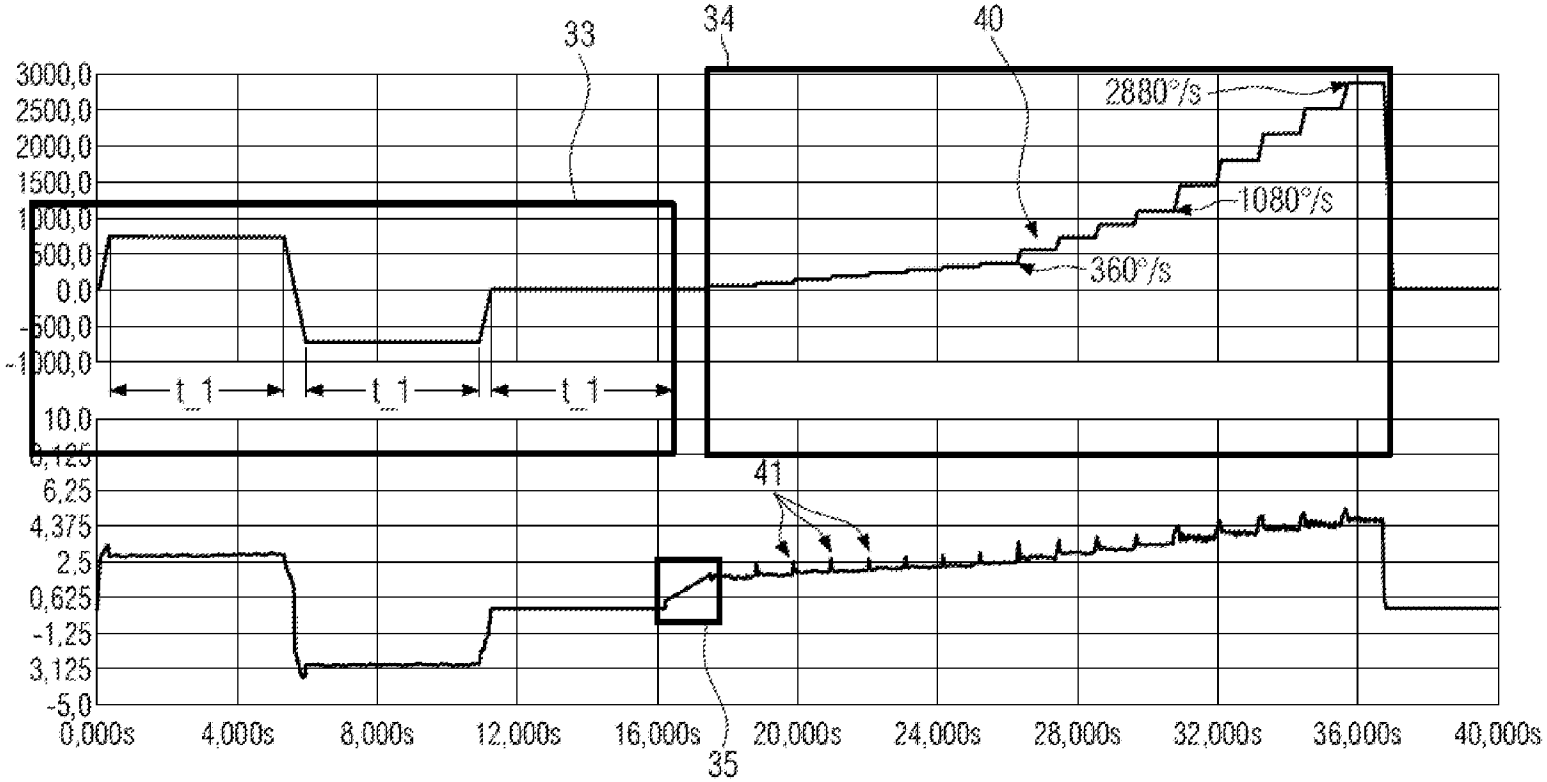
FIG. 3 shows a measurement run or friction detection run for a drive unit of a foil transport device of the packaging machine.

FIG. 3 shows a speed diagram which is performed by means of one of the drive units 27, 28, 31, 32 shown or not shown in FIGS. 1 and 2. The speed diagram of FIG. 3 shows a running-in interval 33. During the running-in interval 33, the drive unit 27, 28, 31, 32 is moved in both directions to remove an adhesion effect. Subsequently, a measurement run 34 takes place. During the measurement run 34, the drive unit 27, 28, 31, 32 is accelerated in steps over its total speed range. By means of the measurement run 34 performed in this manner, the own friction of the drive unit 27, 28, 31, 32 can be determined for the respective speed steps. The measurement run 34 thus represents a friction detection run for the respective drive units 27, 28, 31, 32.

FIG. 3 shows that during the measurement run 34, speed steps that become increasingly larger are carried out. Along the constant velocity plateaus 40 arising therefrom, the friction moment of the drive units 27, 28, 31, 32 resulting for it can be detected. Here, the respective friction moment is directly proportional to a power supply employed for the respective velocity plateau 40 whose progression is shown in FIG. 3 below the speed curve.

Above all, FIG. 3 shows that directly at the beginning of the measurement run 34 during the switching to the first velocity plateau 40, at the drive unit 27, 28, 31, 32, a transition 35 between a static friction and a sliding friction can be measured. This transition 35 is shown in FIG. 3 by the increase of the intensity of current between the running-in interval 33 and the measurement run 34.

FIG. 3 furthermore shows, in the current progression represented therein, that an increase in the speed at the beginning of the velocity plateau 40 leads to peak powers 41 in the power supply. The peak powers 41 provoked at the respective velocity plateaus 40 at the beginning by the controlled speed increase then, however, flatten with a constant speed. By means of the power supply values occurring during the measurement run 34 for the velocity plateaus 40 and which are substantially smoothed, a friction moment characteristic curve 38 (see FIG. 4) can be determined by means of the controlling system 13, 24.

Figure 4:
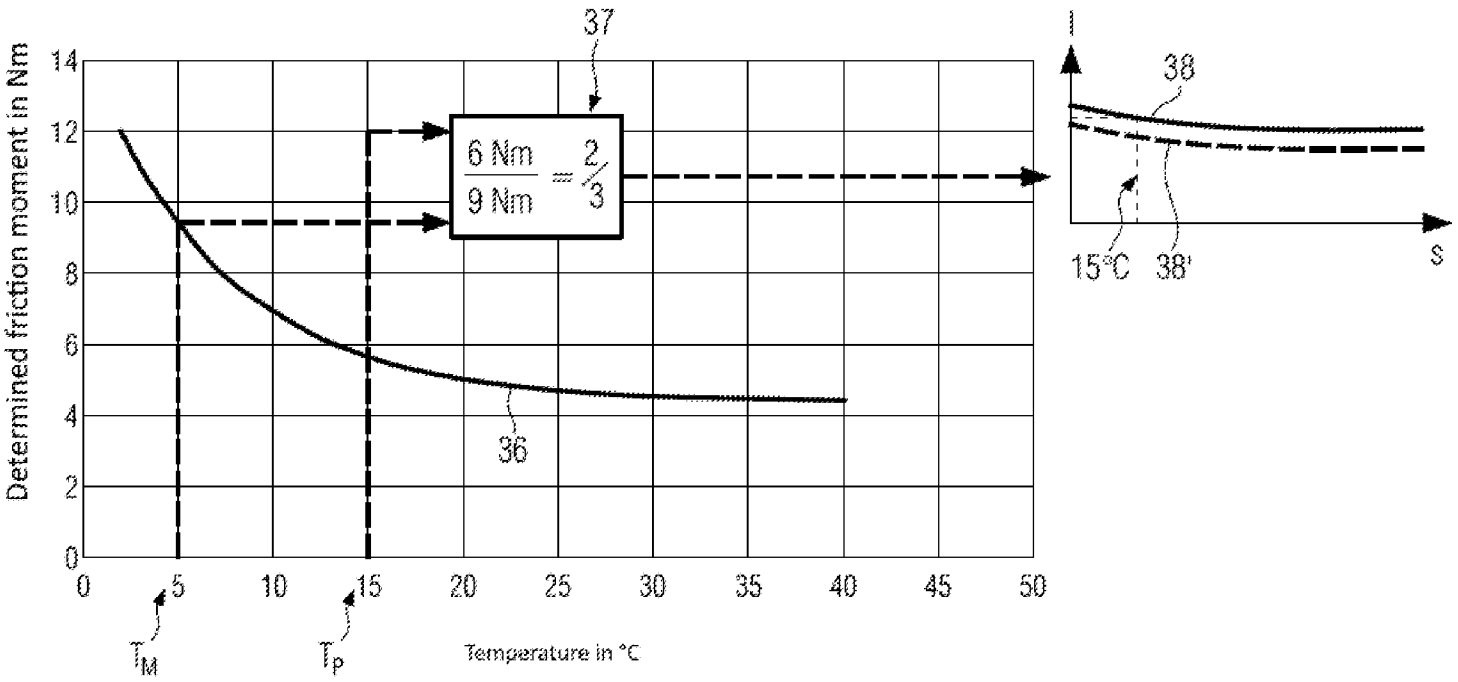
FIG. 4 shows a friction moment-temperature characteristic curve for determining a temperature compensation factor.

FIG. 4 shows a friction moment-temperature characteristic curve 36 which can be, for example, stored for one of the drive units 27, 28, 31, 32, or for one of the above-mentioned, other drive units of the controlling system 13, 24.

By means of the friction moment-temperature characteristic curve 36 shown in FIG. 4, a temperature compensation factor 37 can be determined for the corresponding drive unit 27, 28, 31, 32. The temperature compensation factor 37 forms a quotient from a torque which is depicted by means of the friction moment-temperature characteristic curve 36 for a currently measured operating temperature of the drive unit 27, 28, 31, 32, and from a friction moment which is present in the friction moment-temperature characteristic curve 36 at the temperature at which the measurement run 34 of FIG. 3 has been carried out.

By means of the temperature compensation factor 37, it is possible to adapt the speed required for a desired foil tension of FIG. 3, that means the power supply assumed for this based on the friction moment characteristic curve 38, in view of the current operating temperature of the drive unit 27, 28, 31, 32, so that during the production run, a constant foil tension can be achieved even at varying operating temperatures of the drive unit 27, 28, 31, 32.

In FIG. 4, the friction moment from the friction moment-temperature characteristic curve 36 for an operating temperature of 15° C. is determined by way of example, which is, according to FIG. 4, approximately 6 Nm. It is furthermore assumed that the measurement run 34 of FIG. 3 has been performed at a measurement run temperature of 5° C. The friction moment-temperature characteristic curve 36 of FIG. 4 indicates a friction moment of 9 Nm for 5° C., so that the quotient from the respective friction moments is ⅔.

FIG. 4 furthermore shows the only schematically represented friction moment characteristic curve 38 which is accomplished by means of the measurement run 34, i.e., depending on the power supply of the drive unit 27, 28, 31, 32 required for this and shown in FIG. 3. On the basis of the friction moment characteristic curve 38, for the drive unit 27, 28, 31, 32, the controlling system 13, 24 can determine a power supply 38' compensated for the operating temperature 15 measured during the production run using the temperature compensation factor 37, by means of which the drive unit 27, 28, 31, 32 can be operated to maintain the foil tension constant at an operating temperature of 15° C. Here, the assumed power supply resulting from the measurement run 34 for the speed to achieve the foil tension is corrected by the temperature compensation factor 37.

FIGS. 3 and 4 show that a power supply that can be derived from the measurement run 34 to achieve a certain desired foil tension in view of an operating temperature of the drive unit 27, 28, 31, 32 changing during the production run, provoked by the running operation of the drive unit 27, 28, 31, 32, can be adapted by means of the calculable temperature compensation factor 37 to calculate the power supply of the drive unit 27, 28, 31, 32 actually required for the detected operating temperature which is necessary for achieving a constant and reproducible foil tension.

As one skilled in the art would understand, the controlling systems 13, 24, and any other controller, system, or subsystem described herein may individually, collectively, or in any combination comprise appropriate circuitry, such as one or more appropriately programmed processors (e.g., one or more microprocessors including central processing units (CPU)) and associated memory, which may include stored operating system software and/or application software executable by the processor(s) for controlling operation thereof and for performing the particular algorithms represented by the various functions and/or operations described herein, including interaction between and/or cooperation with each other. One or more of such processors, as well as other circuitry and/or hardware, may be included in a single ASIC (Application-Specific Integrated Circuitry), or several processors and various circuitry and/or hardware may be distributed among several separate components, whether individually packaged or assembled into a SoC (System-on-a-Chip).

What is claimed is:

1. A packaging machine, comprising:

a foil transport device including a drive unit; and a controlling system for controlling an operation of the drive unit of the foil transport device, wherein the controlling system is designed to activate the drive unit during a production run of the packaging machine based on a speed- and/or temperature-dependent friction moment characteristic curve detected by means of a rotationally driven measurement run carried out by the drive unit, wherein the controlling system is designed to determine a measurement run temperature of the drive unit rotationally driven during the measurement run, and wherein the controlling system is configured to determine, based on a friction moment-temperature characteristic curve stored to the controlling system for the drive unit, a temperature compensation factor for the activation of the drive unit which is derived therefrom in view of a currently detected operating temperature of the drive unit and in view of the measurement run temperature detected during the measurement run.

2. The packaging machine according to claim 1, wherein the drive unit includes a servo drive.

3. The packaging machine according to claim 1, wherein the drive unit is activatable, for detecting the friction moment characteristic curve over a total speed range of the drive unit.

4. The packaging machine according to claim 3, wherein the drive unit is activatable to speed levels continuously increasing in steps to detect the friction moment characteristic curve.

5. The packaging machine according to claim 1, wherein the drive unit is activatable to speed levels continuously increasing in steps to detect the friction moment characteristic curve.

6. The packaging machine according to claim 1, wherein the packaging machine is a deep-drawing packaging machine or a tray sealer.

7. The packaging machine according to claim 1, wherein the foil transport device includes a further drive unit, the controlling system being designed to activate the further drive unit during a production run of the packaging machine based on a speed- and/or temperature-dependent friction moment characteristic curve detected by means of a rotationally driven measurement run carried out by the further drive unit.

8. A method for controlling a drive unit of a foil transport device which supplies, at a packaging machine during a production run taking place thereat, a foil with a predetermined foil tension to a workstation of the packaging machine, wherein the drive unit is controlled, during the production run of the packaging machine, based on a speed- and/or temperature-dependent friction moment characteristic curve detected by means of a rotationally driven measurement run carried out by the drive unit; and wherein a controlling system determines, based on a friction moment-temperature characteristic curve stored to the controlling system for the drive unit, a temperature compensation factor for activation of the drive unit in view of an operating temperature of the drive unit currently detected during the production run and in view of a measurement run temperature detected during the measurement run.

9. The method according to claim 8, wherein the controlling system derives a power supply of the drive unit for achieving a desired foil tension from the detected friction moment characteristic curve during the production run and dynamically adapts the power supply by means of the temperature compensation factor determined in view of the current operating temperature.

10. The method according to claim 8, wherein the drive unit is rotated into both directions during a predetermined running-in interval before the measurement run.

11. The method according to claim 10, wherein the drive unit is accelerated in steps during a measurement section of the measurement run performed after the running-in interval with a continuously increasing speed for determining the friction moment characteristic curve.

12. A method for controlling a drive unit of a foil transport device which supplies, at a packaging machine during a production run taking place thereat, a foil with a predetermined foil tension to a workstation of the packaging machine, wherein the drive unit is controlled, during the production run of the packaging machine, based on a speed- and/or temperature-dependent friction moment characteristic curve detected by means of a rotationally driven measurement run carried out by the drive unit, and wherein the drive unit is rotated in two directions during a predetermined running-in interval before the measurement run.

13. The method according to claim 12, wherein the drive unit is accelerated in steps during a measurement section of the measurement run performed after the running-in interval with a continuously increasing speed for determining the friction moment characteristic curve.

* * * * *